US008360819B2

(12) United States Patent
Junker

(10) Patent No.: US 8,360,819 B2
(45) Date of Patent: Jan. 29, 2013

(54) METHOD FOR GRINDING A MACHINE PART, AND GRINDING MACHINE FOR CARRYING OUT SAID METHOD

(75) Inventor: Erwin Junker, Buehl/Baden (DE)

(73) Assignee: Erwin Junker Maschinenfabrik GmbH, Nordach (DE)

( * ) Notice: Subject to any disclaimer, the term of this patent is extended or adjusted under 35 U.S.C. 154(b) by 824 days.

(21) Appl. No.: 12/449,122

(22) PCT Filed: Feb. 27, 2008

(86) PCT No.: PCT/EP2008/052395

§ 371 (c)(1),
(2), (4) Date: Jul. 22, 2009

(87) PCT Pub. No.: WO2008/104571

PCT Pub. Date: Sep. 4, 2008

(65) Prior Publication Data

US 2010/0048104 A1 Feb. 25, 2010

(30) Foreign Application Priority Data

Feb. 28, 2007 (DE) ..... 10 2007 009 843

(51) Int. Cl.
*B24B 49/00* (2006.01)

(52) U.S. Cl. ..... 451/11; 451/27; 451/49; 451/51; 451/57; 451/180; 451/246; 451/249

(58) Field of Classification Search ..... 451/10, 451/11, 27, 49, 51, 57, 178, 180, 242, 246, 451/249

See application file for complete search history.

(56) References Cited

U.S. PATENT DOCUMENTS

| | | | | |
|---|---|---|---|---|
| 3,634,974 | A * | 1/1972 | Kikuchi et al. | 451/24 |
| 4,987,703 | A * | 1/1991 | Brill | 451/28 |
| 5,076,022 | A | 12/1991 | Ohta et al. | |
| 6,145,419 | A * | 11/2000 | Laycock | 82/1.11 |
| 6,913,522 | B2 | 7/2005 | Junker | |

FOREIGN PATENT DOCUMENTS

| | | |
|---|---|---|
| DE | 23 33 041 | 1/1975 |
| DE | 38 17 161 | 12/1988 |
| DE | 101 44 644 | 4/2003 |
| EP | 0 145 965 | 6/1985 |
| EP | 0 361 446 | 4/1990 |

* cited by examiner

*Primary Examiner* — Eileen P. Morgan
(74) *Attorney, Agent, or Firm* — Jordan and Hamburg LLP

(57) ABSTRACT

Disclosed is a method for grinding a machine part that is used as a drive shaft, for example, rotates about the longitudinal axis thereof during the grinding process, and is provided with a journal at one axial end thereof and a recess at the opposite end thereof. The grinding process is carried out in one and the same grinding machine. In said grinding method, the machine part is brought into different clamped states by means of a chuck of a workpiece spindle head with releasable clamping jaws and a centering tip, a backrest, and/or a tailstock quill. Changing the clamped states has the advantage that the machine part remains in the same position in a single grinding machine, i.e. the clamped position, in all the different clamped states such that more accurate sizes, shapes, and positions can be obtained in an economical manner and all areas of the machine part which are to be ground are successively accessible to the grinding disks.

12 Claims, 9 Drawing Sheets

METHOD FOR GRINDING A MACHINE PART, AND GRINDING MACHINE FOR CARRYING OUT SAID METHOD

BACKGROUND OF THE INVENTION

The invention relates to a method for grinding a machine component that is driven to rotate about its longitudinal axis and that has at its one axial end a journal and at its opposing end an interior recess, wherein exterior surfaces are ground using a first grinding wheel and the circumferential surface of the interior recess is ground using a second grinding wheel and a workpiece headstock, a tailstock, and at least one steady are provided for clamping the machine component during grinding, and relates to a grinding machine like a universal, circular, or non-circular grinding machine for performing the method.

When grinding such machine components that have a relatively complicated configuration, it is known to clamp the machine component at its ends between a workpiece headstock and a tailstock and to grind different areas on the exterior contour of the machine component using different grinding wheels. If there is a recess at the end of the machine component, it has been suggested to clamp the machine component on one side and at the opposing freely accessible end of the machine component to grind both exterior areas and the contour of the interior recess using grinding wheels having different sizes. Such a method may be found for instance in DE 23 33 041. With machine components that are clamped on one side, it is also customary to support the opposing free end with a steady. DE 101 44 644 A1 describes using steadies for supporting rotating workpieces during grinding using a plurality of grinding wheels.

In all of these cases, the required machining processes can be performed in a single, unchanged clamping process on one and the same machine.

However, the machine component to be ground in accordance with the invention has at its one end a journal that has a smaller diameter compared to the other areas of the machine component. This journal must also be centered very precisely and then circle-ground on its exterior circumference. In addition, the exterior areas and the interior recess must be ground. In this case it is not possible to grind using the known methods because certain areas of the machine component are not accessible when the normal clamping methods are used. In particular if the machine component in question is a gear shaft, the demands on accuracy are very stringent with respect to dimensional accuracy and centering. In some cases even the slightest changes, which can occur due to inaccuracy when grinding, can lead to extremely disadvantageous effects.

SUMMARY OF THE INVENTION

It is therefore the object of the invention to provide a grinding method and a grinding machine with which the machine component can be at least finish-ground in a single grinding machine and without intermittent position changes, i.e. under clamped conditions that remain the same to the greatest extent possible.

With the method and the grinding machine in accordance with the invention it is possible to adjust to different clamped conditions without having to change the position of the machine component in the grinding machine, the so-called clamped position, to do so.

The following clamped positions should be stressed:

a) Clamping on the axial ends of the machine component between workpiece headstock and tailstock;

b) The journal of the machine component is grasped by releasable clamping jaws that draw the journal against the centering tip of the workpiece headstock; the free end of the machine component is supported by means of a steady;

c) With the clamping jaws drawn in, the machine component is clamped between the centering tip of the workpiece headstock and the sleeve tip that engages in the interior recess of the machine component.

With the exception of the journal, all of the exterior areas of the machine component can be machined in clamped condition a. Circular and non-circular grinding are possible. Not only can circumferential areas be ground on the exterior contour of the machine component, but also end faces and tapered transition surfaces. In clamped condition a it is also possible to grind at least one steady seat. The steady seat can be ground while the exterior contours are ground or in a separate work step. It is particularly desirable to prepare the steady seat as the first work sequence after exterior grinding and prior to grinding the interior recess. Turned recesses can also be added with no problem in clamped condition a.

In clamped condition b, the machine component is already centered by the centering tip of the workpiece headstock and the positioned steady. In this clamped condition it is possible to grind the circumference of the interior recess with great accuracy. Both circular and non-circular grinding are possible, the X, Z, and at least C axes travel in an interpolated manner. Prismatic contours for the interior recess are possible with nothing further, as is a tapered longitudinal progression for the interior recess.

In clamped condition c it is possible to grind the round cross-section of the journal with more precise centering without it being necessary to change the clamped position of the machine component within the grinding machine. A certain axial thrust exerted by the tailstock is enough for the centering tip of the workpiece headstock to cause the machine component to rotate because the rotational resistance during circular grinding of the relatively small journal is significantly lower than with the other grinding processes.

CBN grinding wheels must be used for grinding in all of the clamped conditions.

The grinding allowance for the interior recess can be determined in that the distance between one shoulder of the machine component and the sleeve of the tailstock is determined using an electronic positioning head.

The interior recess of the machine component can have a conical or cylindrical contour, or, as stated in the foregoing, any desired contour. However, a centering bore of preferably 60° must be required. If a correspondingly conically configured interior recess is provided anyway, it can naturally be used directly for centering.

Using the inventive method and the grinding machine therefor it is possible to precision-grind the machine component in question with particularly high quality using one and the same grinding machine. In this manner it is possible to produce significantly enhanced dimensional, shape, and position accuracies on the machine part. Moreover, no interim storage for semi-finished parts is required because the workpiece is completely precision ground in one and the same machine. This means that there is no need for expensive interim storage for semi-finished parts.

The invention is described in the following in greater detail using exemplary embodiments that are depicted in the drawings.

DETAILED DESCRIPTION OF THE INVENTION

Figure 1:
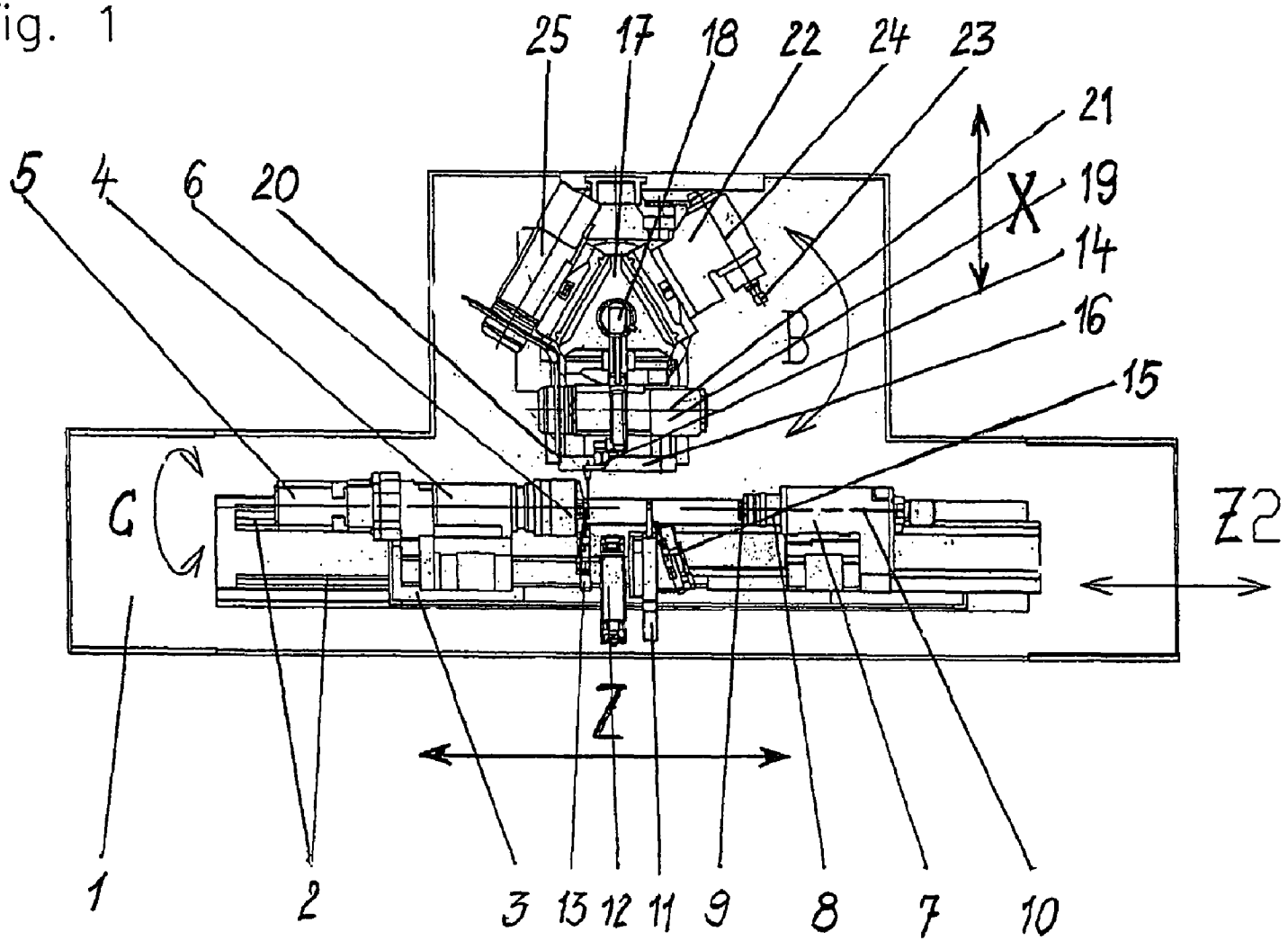
FIG. 1 depicts a view from above onto a grinding machine for performing the inventive method.
Figure 8:
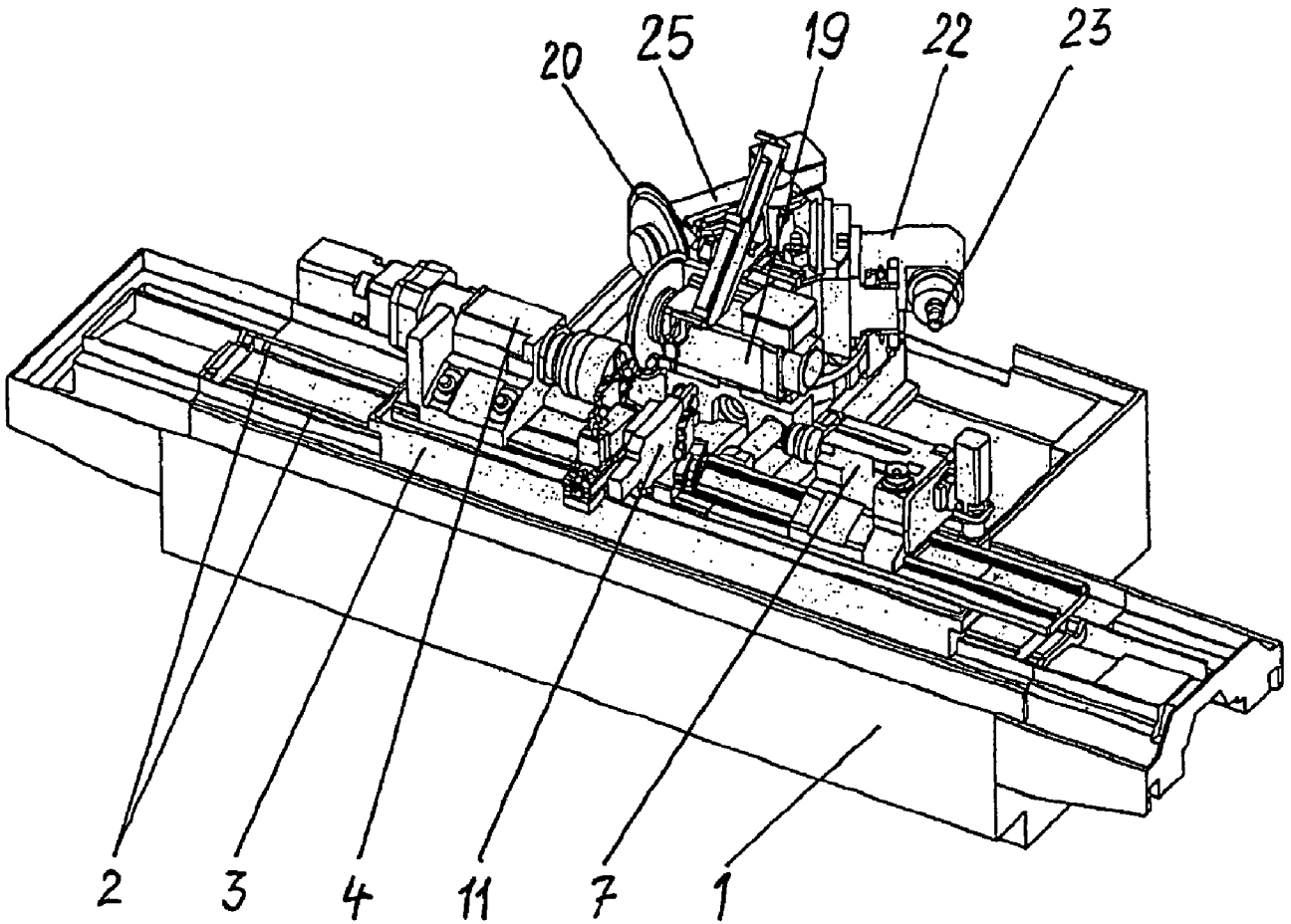
FIG. 8 is a perspective view from above onto the grinding machine depicted in FIG. 1.

The grinding machine depicted in FIGS. 1 and 8 fundamentally proceeds from the typical structure of a universal circular and non-circular grinding machine. Disposed on a machine bed 1 are two guides 2 on which the grinding table 3 can be longitudinally displaced in the direction of the so-called Z2 axis. The workpiece headstock 4 is attached with its drive motor 5 and a chuck 6 to the grinding table 3. The chuck clamps the machine component 31, to which end a centering tip 26 and releasable clamping jaws 27 are provided (see FIGS. 2 through 4).

Arranged coaxial with the workpiece headstock 4 axially spaced therefrom is the tailstock 7. The latter has the usual tailstock sleeve 8 that terminates in an adapted sleeve tip 9 (FIG. 3). The tailstock 7 can be moved longitudinally on the grinding table 3, the machine part 31 being clamped as usual between the workpiece headstock 4 and the tailstock 7 with a common rotational axis 10 (see FIGS. 2 through 4).

Figure 9:
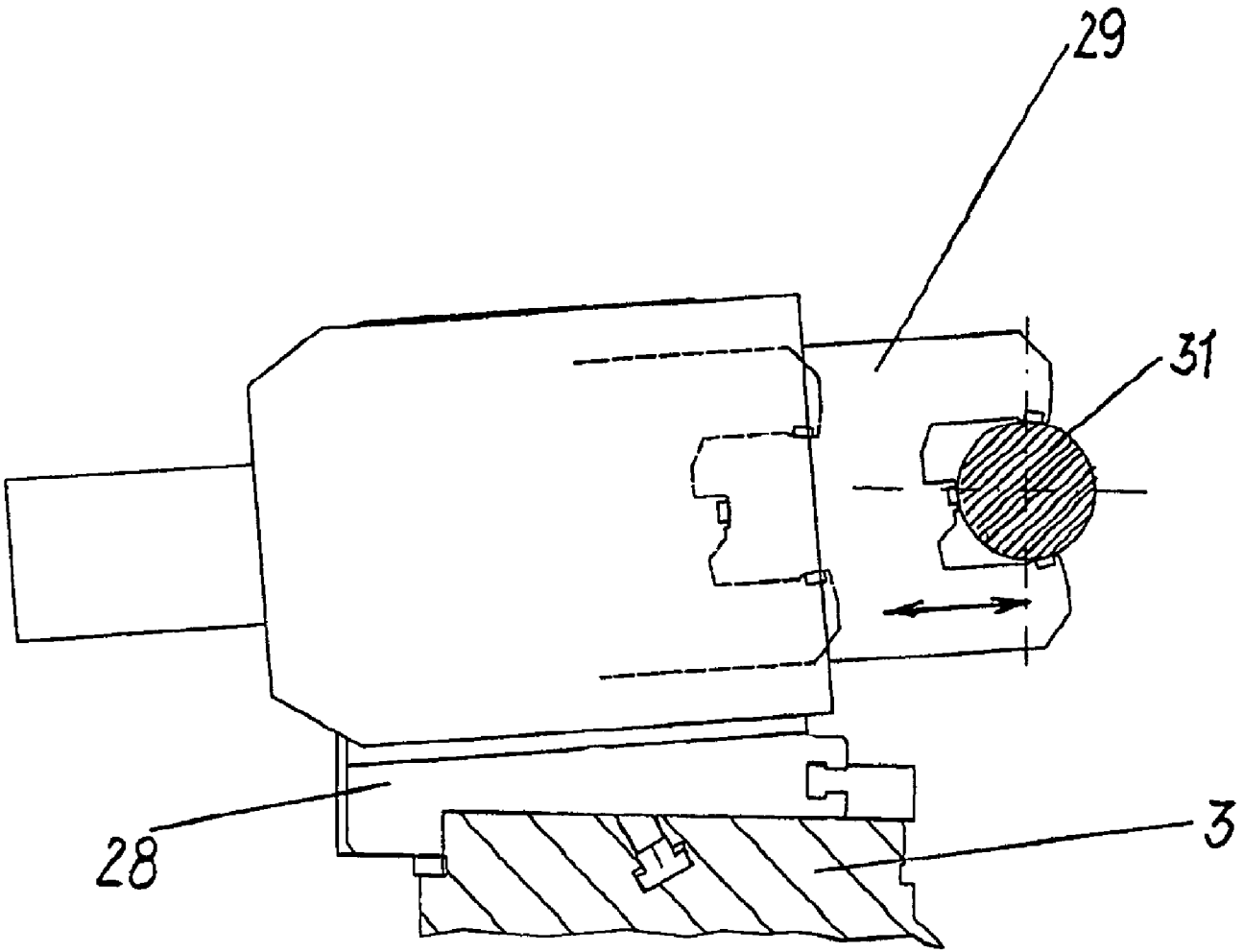
FIG. 9 is a side view of the steady that belongs to the described grinding machine.

Labeled 11 is a steady that comprises a steady base 28 and a movable support part 29 (FIG. 3). When the steady 11 is active the movable support part 29 extends and partially encloses the circumference of the machine component 31, as can be seen particularly well in FIGS. 3 and 9.

A total of four measuring devices 13, 14, 15, and 30 are shown in the figures, and they control and regulate the grinding process. A dressing device 12 dresses the grinding wheels present on the grinding machine.

The grinding machine is equipped with three grinding spindles 19, 22, and 25 that are all disposed on a common grinding headstock 17. The grinding headstock 17 is arranged pivotable about a vertical pivot axis 18 on a slide 16 that can itself be displaced perpendicular to the common rotational axis 10, that is, in the direction of the usual X axis. The pivot movement is indicated by the curved arrow B and the slide displacement movement is indicated by the straight, two-headed arrow X. Z and Z2 indicate the displacement directions in the longitudinal direction of the workpiece and parallel thereto, respectively, while C depicts the rotation of the machine component 31 about the common rotational axis 10.

The first grinding wheel 19 bears the first grinding wheel 20, which rotates about the first rotational axis 21. The first grinding wheel 20 grinds the outer contour of the machine component 31. In the exemplary embodiment selected here, the first grinding wheel 20 has two abrasive layers 20*a* and 20*b* arranged perpendicular to one another; the first grinding wheel 20 can therefore grind both rotationally symmetrical circumferential surfaces and also end faces that are at the top in the exemplary embodiment see especially FIG. 4).

The second grinding spindle 22 bears the second grinding wheel 23, which rotates about the second rotational axis 24, has a small diameter, and grinds the rotationally symmetrical interior recess 36 of the machine component 31, as depicted in particular in FIG. 3.

Only the first grinding spindle 19 and the second grinding spindle 22 are needed to perform the inventive method.

Labeled 25 is a third grinding spindle that can be used for additional machining processes such as for instance in circumferential or end faces that are to be ground or turned recesses that are to be ground.

Figure 6:
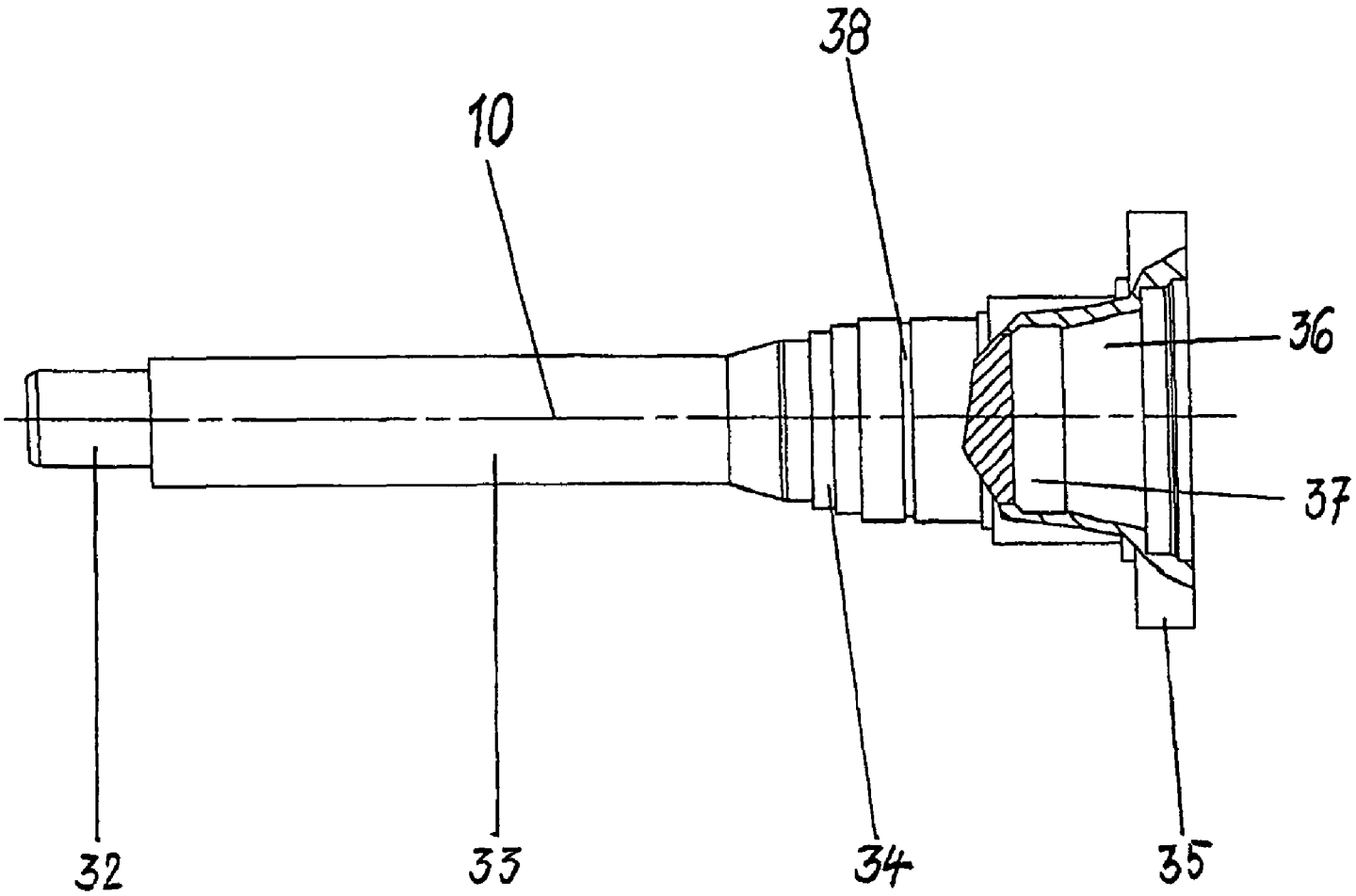
FIG. 6 depicts as an example a first typical machine component that is to be ground using the inventive method.

FIG. 6 illustrates an example of a rotationally symmetrical machine component 31 that is to be ground in accordance with the inventive method. The machine component 31 has a cylindrical base shape and has a journal 32 at its one end. Connected to the journal 32 is a longitudinally extended shaft part 33 that transitions into a flange 35 via a transition part 34. The contour of the transition part can be stepped or tapered or both. Even grooves 38 are possible. At its end that opposes the journal 32 and that is provided with the flange 35, the machine component 31 has a rotationally symmetrical interior recess 36. In the exemplary embodiment depicted in accordance with FIG. 6, the latter has a contour that is partially a stepped cylinder and partly tapered and that transitions into an undercut area 37.

Figure 7:
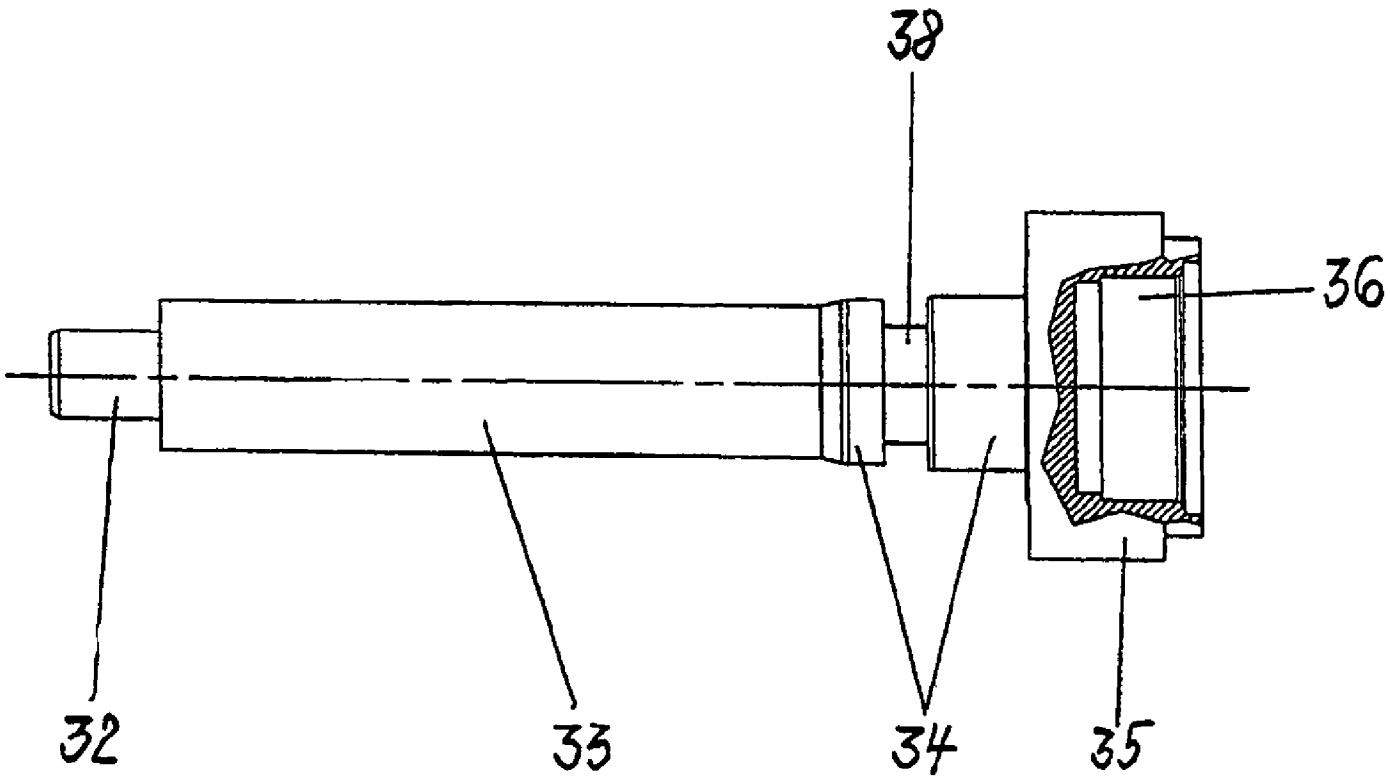
FIG. 7 depicts another example for such a machine component.

FIG. 7 depicts another example of a machine component that is to be ground in accordance with the inventive method. The transition area 34 has a larger groove 38 than in the exemplary embodiment in FIG. 6. Furthermore, the rotationally symmetrical interior recess 36 here has a cylindrical contour that is only stepped.

Figure 2:
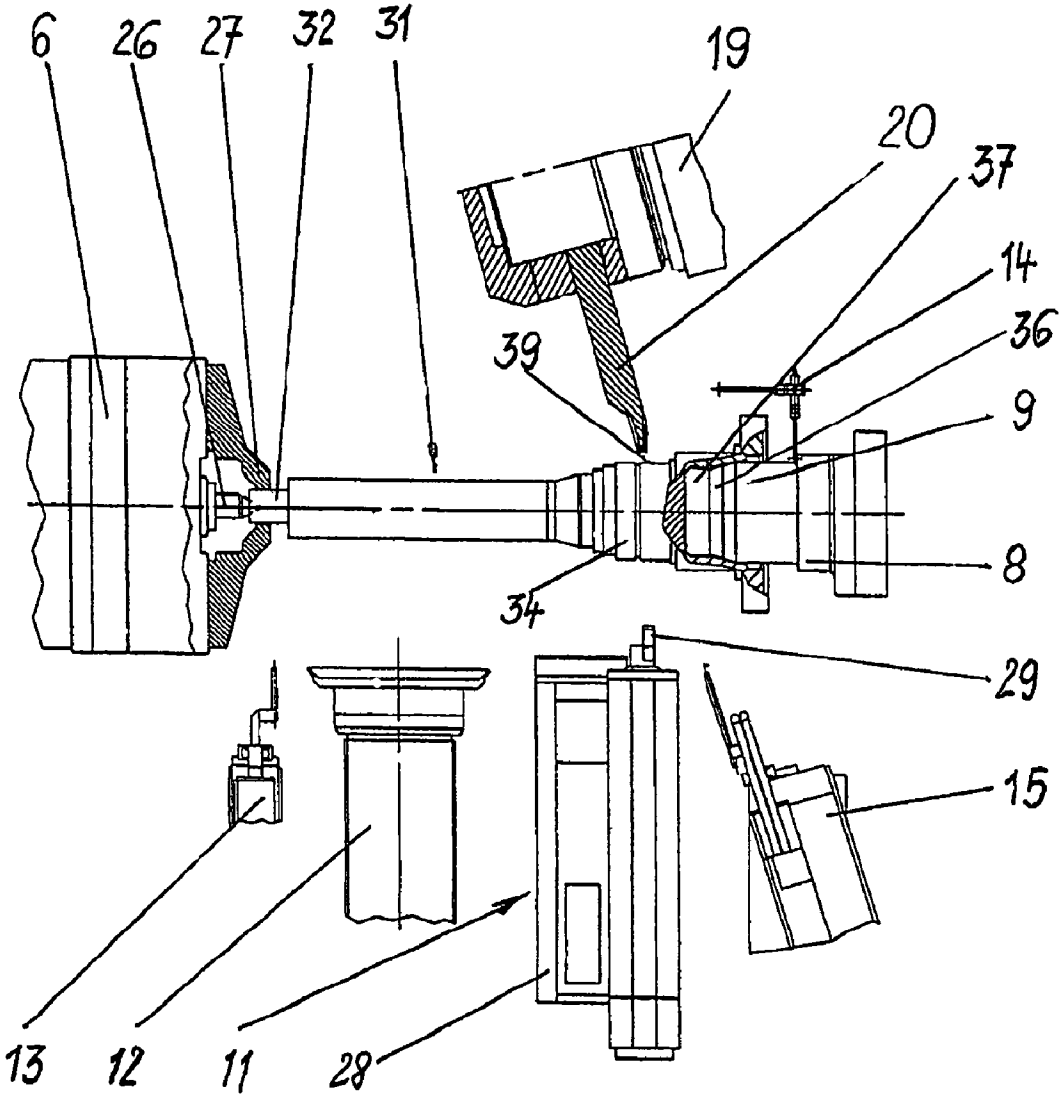
FIG. 2 illustrates a first phase in the sequence of the inventive method.
Figure 3:
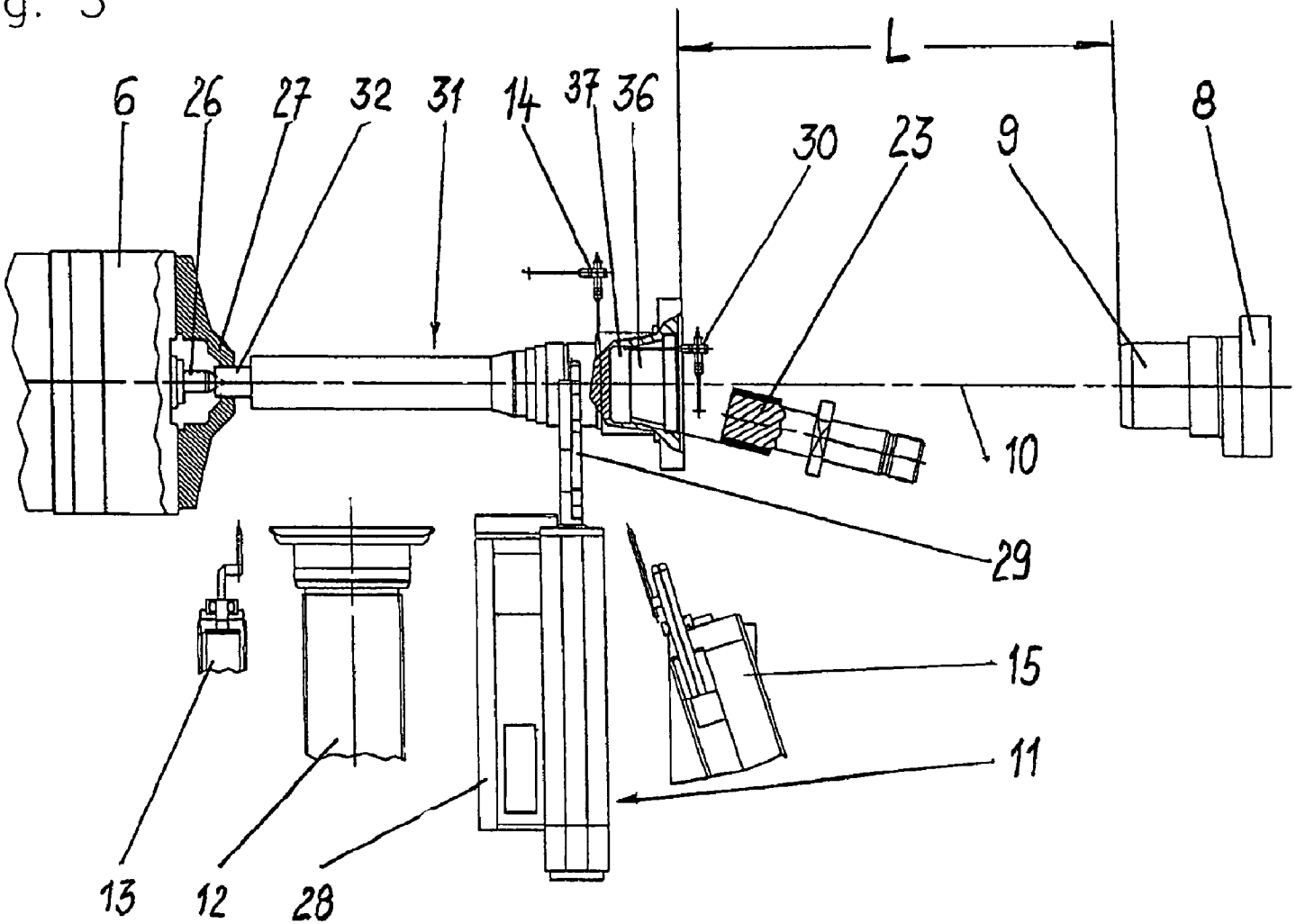
FIG. 3 depicts a next additional phase of the method.

FIGS. 2 through 5 shall now be used to explain in detail how the method proceeds with the described grinding machine. FIG. 2 depicts the workpiece, that is the machine component 31, in its first clamped condition. Using its centering tip 26, the chuck 6 of the workpiece headstock 4 centeringly engages in the journal 32 of the machine component 31. The end face of the journal 32 must have a corresponding recess for this. Furthermore, the releasable clamping jaws 27 surround the exterior circumference of the journal 32. The clamping jaws 27 clamp the machine component 31 on the exterior circumference of the journal 32 and are borne equally in the radial direction with respect to the centering tip 26 of the chuck 6.

In addition, the clamping jaws 27 are engineered such that the machine component 31 is pressed in the axial direction onto the centrically circumferential centering tip 26 of the chuck 6.

In this manner increased centering accuracy for the machine component 31 is attained.

On the opposite side of the machine component 31, the conically adapted pin 9 of the tailstock sleeve 8 is inserted into the tapered interior recess 36.

The steady 11 is in its retracted position; its movable support part 29 is retracted. In this first clamped position, the first grinding wheel 20 is positioned against the transition area 34 of the machine component 31, and a steady seat 39 is ground there. The grinding location is indicated by a short double line. The grinding performed is peel grinding, the grinding direction in FIG. 2 going from right to left, that is, in the direction of the workpiece headstock 4.

The common rotational axis 10 and the first rotational axis 21 are not in a common plane, but rather are also positioned in a vertical direction somewhat obliquely to one another so that there is largely only point contact on the grinding location.

FIG. 3 illustrates the next machining phase. The first grinding spindle 19 is retracted to its idle position and the movable support part 29 of the steady 11 partly surrounds the ground steady seat 39; see also FIG. 9.

Furthermore, the tailstock 7 has withdrawn from the machine component 31 in the axial direction so that the second grinding spindle 22 can be brought into the active position in front of the rotationally symmetrical interior recess 36 of the workpiece 31 by pivoting the grinding headstock 17 about the pivot axis 18. The tailstock 7 must be withdrawn by a length L, which is not available on conventional universal circular and non-circular grinding machines and which is long enough that the second grinding spindle 22 can be inserted in the space between tailstock 7 and machine component 31 for interior grinding. The length L is approximately 3 to 5-times longer than the conventional sleeve travel. This creates the second clamped condition. Now the rotationally symmetrical circumferential surface of the interior recess 36 is ground using the second grinding wheel 23.

Figure 4:
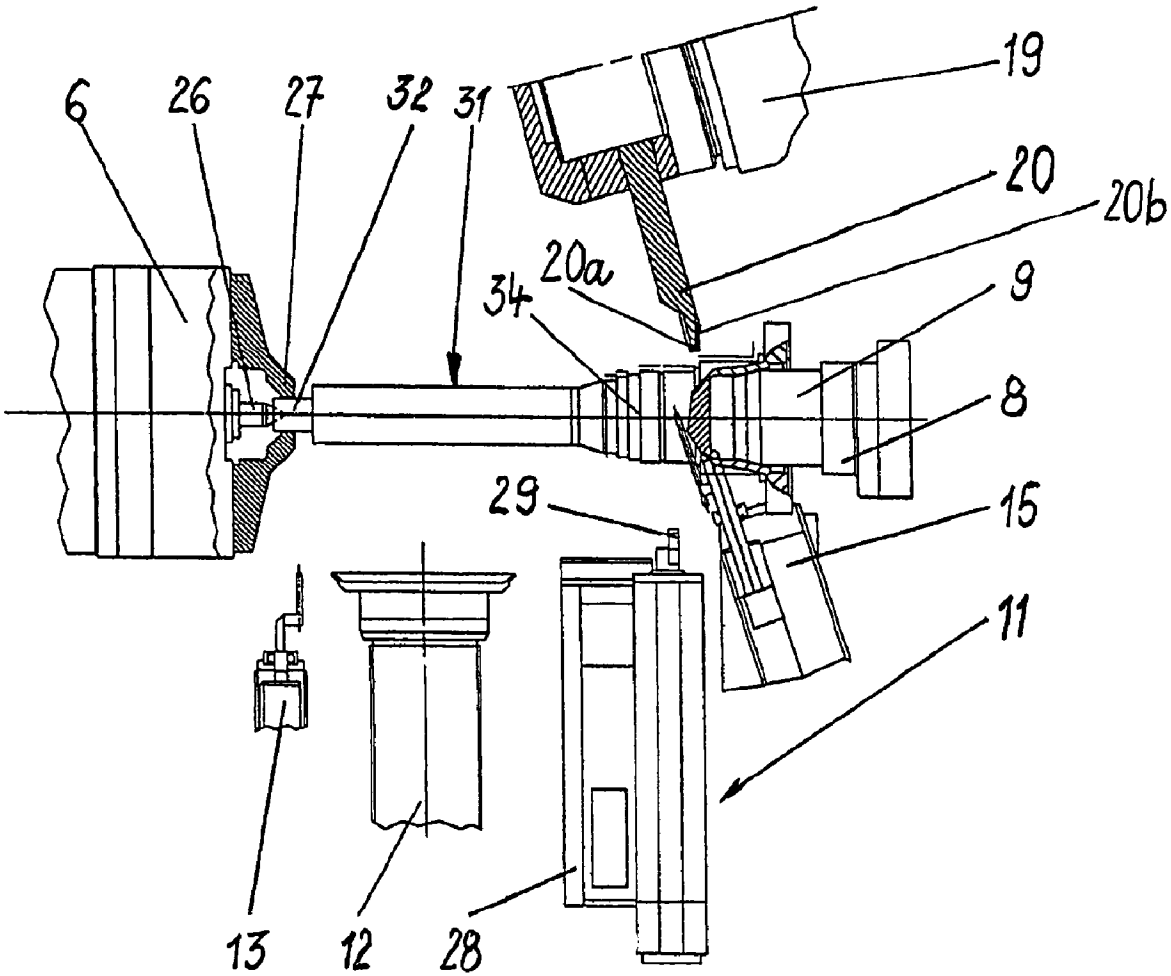
FIG. 4 depicts the subsequent next phase.

FIG. 4 depicts the next, third phase of the grinding process. The second grinding spindle 24 is returned to its idle position, and the sleeve tip 9 of the tailstock sleeve 8 is clampingly and centeringly positioned on the interior recess 36 of the machine component 31. The steady 11 is not active now, since its movable support part 29 has been retracted into the steady base 28. Thus overall the first clamped condition is extant as in FIG. 2. Now the first grinding wheel 20 is re-positioned against the exterior contour of the machine component 31 by pivoting the grinding headstock 17. The areas to be ground are particularly identified by additional parallel bars in the exterior contour in FIG. 4; they are primarily located in the transition area 34. In this case, as well, positioning the common rotational axis 10 slightly obliquely with regard to the first rotational axis 21 ensures that during exterior circular grinding, performed as peel grinding, there is largely only point contact between the abrasive layer and the machine component 31.

Thus, in the re-created first clamped condition in accordance with FIG. 4 the entire exterior contour of the machine component 31 can be ground, however with the exception of the journal 32, which is used for clamping by means of the releasable clamping jaws 27.

Figure 5:
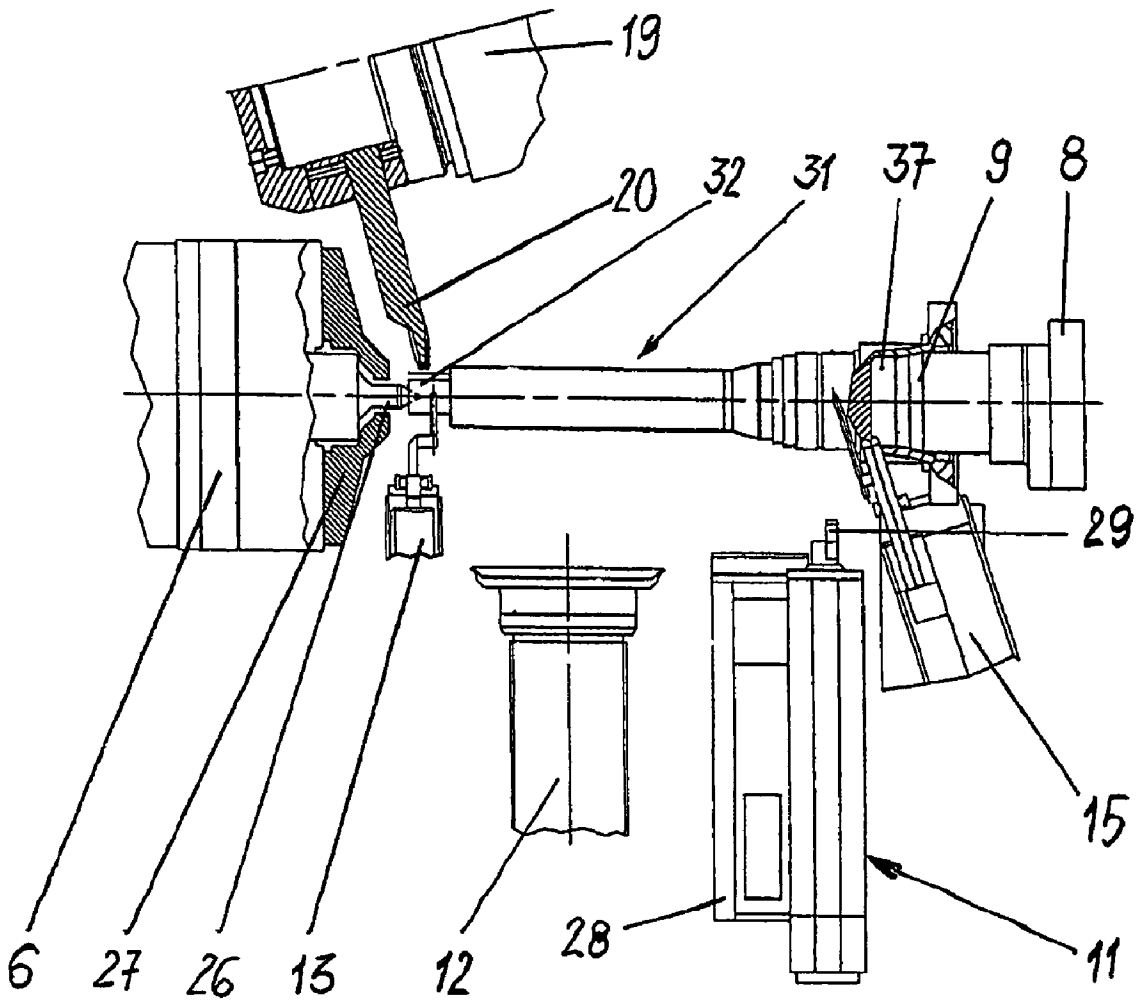
FIG. 5 is the last phase in the sequence of the inventive grinding method.

Finally, however, the journal 32 should also be ground; FIG. 5 depicts this phase of the grinding process. The grinding machine and the machine component 31 are brought into the third clamped condition for this. The releasable clamping jaws 27 are released from the journal 32 and inserted axially into the chuck 6. However, the machine component 31 is now still clamped only between the centering tip 26 of the workpiece headstock and the sleeve tip 9 of the tailstock sleeve. While in the other phases in accordance with FIGS. 2 through 4 the rotational drive for the machine component 31 was largely provided by the releasable clamping jaws 27 of the workpiece headstock 4, the radial turning of the machine component 31 is now provided by friction on the centering tip 26 of the workpiece headstock 4. This is adequate because the rotational resistance during circular grinding of the small journal 32 is significantly less than in the preceding grinding processes.

FIG. 5 also highlights the outer circular grinding of the journal 32 using a parallel double line to the outer contour.

The various phases of the grinding process have been controlled, monitored, and somewhat regulated by the measuring devices 13, 14, 15, and 30. It must be stressed that all method steps have been performed in the same grinding machine with the machine component 31 in an unchanged clamped position.

The machine component can now be unloaded after the finish-grinding.

Other machining processes, such as for instance producing turned recesses, are possible with the third grinding spindle 25, however, provided the latter is not used for entirely different machining purposes.

The invention claimed is:

1. Method for grinding a machine component having at one longitudinal axial end a journal and at its other longitudinal axial end an interior recess having a rotationally symmetrical surface, comprising rotating the machine component about a longitudinal axis thereof, grinding exterior surfaces thereof with a first grinding wheel and grinding said surface of said interior recess with a second grinding wheel, a workpiece headstock, a tailstock, and at least one steady being provided for clamping said machine component during grinding, wherein said grinding method comprises the following sequential steps:

a) effecting a first clamped condition in which a chuck of said workpiece headstock surrounds said journal of said machine component with releasable clamping jaws and at the same time a centering tip of the workpiece headstock engages an end face of said journal, while a tip of a sleeve of the tailstock engages in said interior recess of said machine component;

b) in the first clamped condition, with the first grinding wheel grinding a seat for the steady on an exterior circumference of said machine component and grinding predetermined areas on surfaces of the exterior circumference of said machine component with the exception of said journal;

c) effecting a second clamped condition in which said machine component is supported at said steady seat by said steady and said tailstock is moved far enough away from said machine component in an axial direction of the machine component that said second grinding wheel can be inserted into said interior recess of said machine component upon being moved from an idle position;

d) in the second clamped condition, moving the second grinding wheel from the idle position, inserting the second grinding wheel is said interior recess and grinding therewith said rotationally symmetrical surface of said interior recess;

e) returning said second grinding wheel to its idle position, rendering said steady is inactive, and reinstating the first clamped condition;

f) effecting a third clamped condition in which said clamping jaws of said chuck of said workpiece headstock are released from said journal and drawn axially into said chuck such that said machine component is then clamped only between the centering tip of said workpiece headstock and said tailstock sleeve; and g) in the third clamped condition, with the first grinding wheel grinding a circumference of said journal.

2. Method in accordance with claim 1, wherein said first and second grinding wheels are brought in and out of contact with said machine component by moving a grinding headstock on which the first and second grinding wheels are mounted, the grinding headstock being pivotable and movable linearly on a slide in a direction perpendicular to the longitudinal axis of said machine component.

3. Method in accordance with claim 2, wherein the grinding headstock is pivoted steplessly thereby to position said first and second grinding wheels at different angles against areas of said machine component that are to be ground.

4. Method in accordance with claim 1, wherein the grinding of said steady seat comprises peel grinding with longitudinal advance toward said workpiece headstock.

5. Method in accordance with claim 1, wherein during grinding of the exterior circumference of said machine component a rotational axis of said first grinding wheel and a common rotational axis of said workpiece headstock, machine component, and tailstock are oblique to one another such that essentially only a point contact is created between said first grinding wheel and said exterior circumference of said machine component, longitudinal advance of the grinding of the exterior circumference of the machine component occurring in the direction of said workpiece headstock.

6. Method in accordance with claim 1, further comprising grinding end faces of said machine component with said first grinding wheel.

7. Method in accordance with claim 1, wherein during winding of said machine component said machine component is selectively engaged by one or both of said centering tip and said clamping jaws of said workpiece headstock.

8. Method in accordance with claim 1, wherein the method is CNC controlled.

9. Grinding machine for grinding a machine component having at one axial end a journal and at its other axial end an interior recess having a rotationally symmetrical surface, comprising:

a) a grinding table that can travel in its longitudinal direction, arranged on the grinding table a workpiece headstock and a tailstock configured for disposition of the machine component therebetween, a common longitudinal axis of the workpiece headstock, the machine component, and the tailstock running in the longitudinal direction of said grinding table;

b) said workpiece headstock comprising a centering tip and clamping jaws configured to engage the journal of said machine component;

c) said tailstock comprising a tailstock sleeve having a tip configured for centering engagement in said interior recess of said machine component;

d) at least one steady comprising a base and a movable support part;

e) a grinding headstock arranged on a slide configured to move the grinding headstock perpendicular to the longitudinal direction of said grinding table, a vertical pivot axis supported by the slide and configured to pivot the grinding headstock thereon, the grinding headstock comprising two grinding wheels rotationally driven about respective horizontal axes;

f) whereby said grinding headstock is positionable in two basic positions for said two grinding wheels, in the first basic position said first grinding wheel being positioned on an exterior surface of said machine component, and in the second basic position said second grinding wheel being positioned on the rotationally symmetrical surface of said interior recess; and g) said workpiece headstock and tailstock being arranged for clamping of the machine component therebetween in the first basic position and for the workpiece tailstock to be spaced from said machine component gripped by the workpiece headstock in the second basic position, thereby to form a gap for insertion therein of the second grinding wheel.

10. Grinding machine in accordance with claim 9, wherein said grinding headstock further comprises first and second grinding spindles, the first and second grinding wheels each being mounted on a respective one of the winding spindles and the rotational axes of said two grinding wheels intersecting at an obtuse angle.

11. Grinding machine in accordance with claim 9, wherein said first grinding wheel is provided with an abrasive layer on both circumference thereof and one end face thereof.

12. Grinding machine in accordance with claim 10, wherein the obtuse angle is 120 degrees.

* * * * *